United States Patent [19]

Bouchard et al.

[11] Patent Number: 4,678,520

[45] Date of Patent: Jul. 7, 1987

[54] ELECTRICAL LEAD-INS FOR USE FOR ARC SUSTAINING ATMOSPHERES

[75] Inventors: Andre C. Bouchard, Peabody; Paul A. Thibault, Danvers; Radomir I. Lagushenko, Brookline, all of Mass.

[73] Assignee: GTE Products Corporation, Danvers, Mass.

[21] Appl. No.: 698,216

[22] Filed: Feb. 4, 1985

Related U.S. Application Data

[62] Division of Ser. No. 481,689, Apr. 4, 1983, abandoned.

[51] Int. Cl.[4] ..... C23C 8/14

[52] U.S. Cl. ..... 148/6.35; 313/332

[58] Field of Search ..... 148/6.35; 313/332

[56] References Cited

U.S. PATENT DOCUMENTS

| | | | |
|---|---|---|---|
| 2,543,710 | 2/1951 | Schmidt | 148/6.35 |
| 3,129,124 | 4/1964 | Barney | 148/6.35 |
| 3,870,854 | 3/1975 | Vandenbroucke | 148/6.35 |
| 4,204,137 | 5/1980 | Roy | 313/491 |

*Primary Examiner*—Sam Silverberg

*Attorney, Agent, or Firm*—Carlo S. Bessone; William H. McNeill

[57] ABSTRACT

Electrical shorting between dense arrangements of electrical lead-ins having a normal operating potential difference therebetween in an arc sustaining atmosphere is substantially avoided by providing the lead-ins with an adherent, flexible, oxide coating. The lead-ins are preferably formed from a nickel-iron alloy.

3 Claims, 2 Drawing Figures

ELECTRICAL LEAD-INS FOR USE FOR ARC SUSTAINING ATMOSPHERES

This is a divisional of co-pending U.S. patent application Ser. No. 481,689 filed on April 4, 1983 now abandoned.

TECHNICAL FIELD

This invention relates to single ended, compact fluorescent lamps and more particularly to electrical lead-ins for use in the arc sustaining atmosphere of such lamps.

BACKGROUND ART

The fluorescent lamp is the most widely utilized light source in the world for general illumination, primarily because of its relatively low initial cost and its efficacy: i.e., its light output relative to its power input, usually expressed as lumens per watt (LPW). Nevertheless, for home use, the fluorescent lamp has not taken precedence over the incandescent lamp. Many reasons have been advanced for this lack of acceptance, among them the poor color rendition of some fluorescent lamps and their need for a ballast. However, one of the major disadvantages lies in the fact that a fluorescent lamp is a linear light source whereas an incandescent lamp can almost be considered a point source. The typical fluorescent lamp has a length of from 18" to 8' and is somewhat cumbersome to work with.

With the increasing cost of energy, attempts have been made to overcome the latter difficulty. One of these attempts has utilized a plurality of fluorsecent tubes having one or more smaller tubes connecting the ends of the fluorescent tubes to provide an arc path. Such lamps are shown in U.S. Pat. No. 3,501,662. Large "U" shaped lamps such as those shown in U.S. Pat. Nos. 3,602,755; and 2,401,228; and triple bend lamps such as shown in U.S. Pat. No. 4,347,460 exemplify other attempts.

Still other attempts are shown in U.S. Pat. Nos. 4,208,618; 4,191,907; and 4,524,301, filed Sept. 30, 1982 and assigned to the assignee of the instant invention.

Yet another version comprises a plurality of glass tubes arranged in an assembly with appropriate arc directing means and electrode location to form a continuous arc path (see FIG. 1). The assembly is hermetically sealed within an outer envelope which contains an arc generating and sustaining medium or atmosphere to which all of the glass tubes are permeable.

This latter lamp includes a dense arrangement of electrical lead-ins which attach to the electrodes and thus are subject, when the lamp is operating, to a potential difference between them. Since these electrical lead-ins are positioned in an arc sustaining atmosphere, as opposed to an arc inhibiting atmosphere such as air, or a vacuum, the possibility of unwanted arcing between the lead-ins exists.

Organic insulating materials such as silicones and fluoropolymers are ineffective because of their outgassing characteristics.

Inorganic electrically insulating coatings containing glass and/or ceramic ingredients are also undesirable because it is difficult to match the expansion properties of wires to those of the glass and ceramic coatings available. It is also difficult to eliminate all of the pores in the applied coating, thus allowing shorting of the discharge in the regions of the pores.

Further, lead-ins so coated lose flexibility, an important feature.

DISCLOSURE OF THE INVENTION

It is, therefore, an object of this invention to obviate the disadvantages of the prior art.

It is another object of the invention to enhance the operation of compact fluorescent lamps.

It is another object of the invention to substantially inhibit arcing between lamp electrical lead-ins.

Yet another object of the invention is the provision of methods for making electrical lead-ins which will achieve the above-recited objects.

These objects are accomplished, in one aspect of the invention, by the provision, in a fluorescent lamp having a dense arrangement of electrical lead-ins with a potential difference therebetween in an arc sustaining atmosphere, of a highly adherent insulating coating on the lead-ins. The coating provides an arcing potential between the electrical lead-ins that is greater than the normal operating potential between the lead-ins.

The employment of this coating allows the use of densely packed lead-ins with a potential difference between them in an arc sustaining atmosphere.

The coating can be a highly adherent oxide which is formed by applying a gas-oxygen flame to the lead-ins or, alternatively, passing an electric current through the lead-ins in an oxygen atmosphere, the current being sufficient to heat the lead-ins to red heat.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
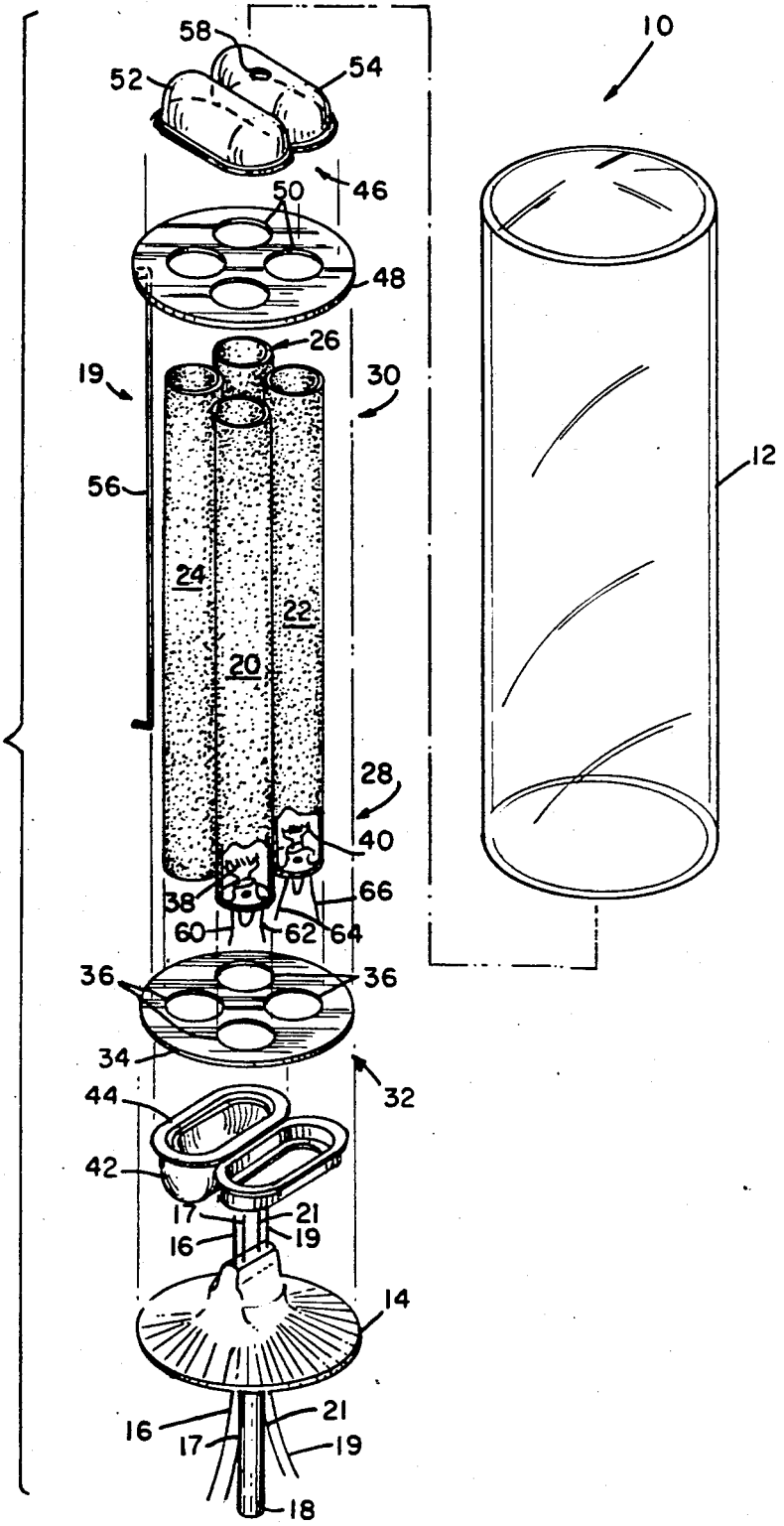
FIG. 1 is an exploded, perspective view of a lamp in which the invention can be employed.
Figure 2:
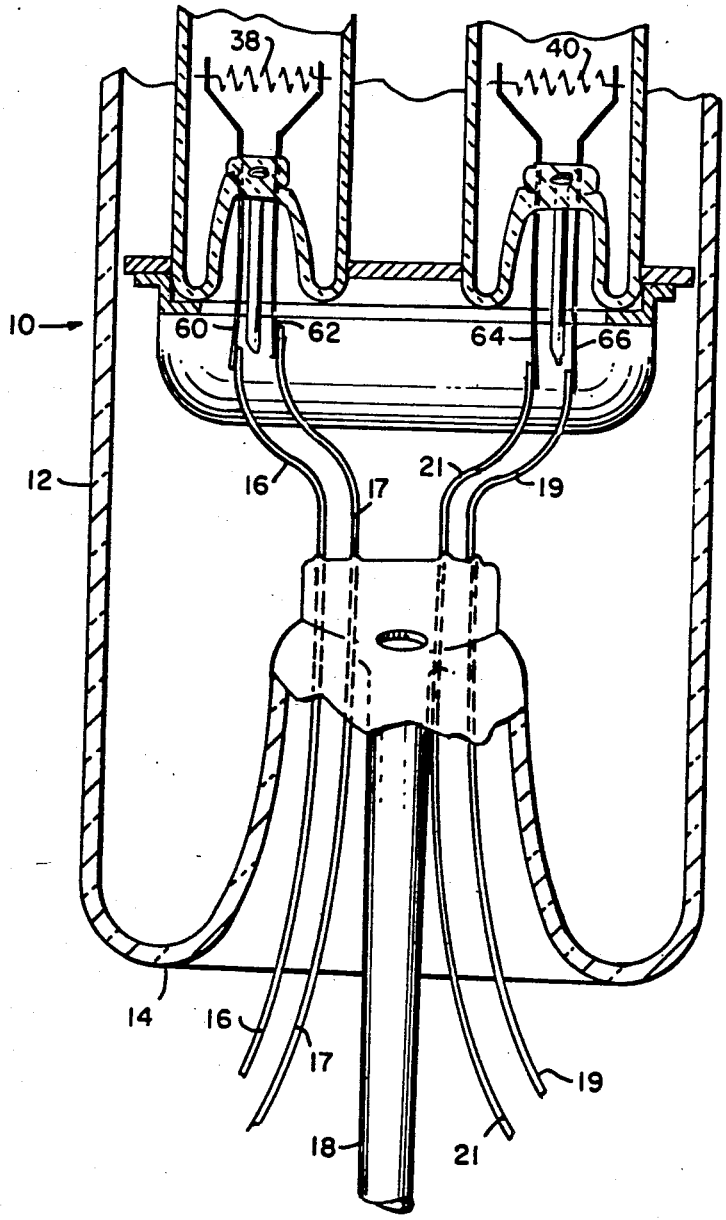
FIG. 2 is an enlarged, sectional view of a portion of the lamp of FIG. 1.

Referring now to the drawings with greater particularity, there is shown in FIG. 1 a lamp 10 with which the invention can be advantageously employed.

Lamp 10 is a single ended, compact fluorescent lamp having an outer envelope 12 which is hermetically sealed to a flare 14 which includes a dense arrangement of lead-in wires 16, 17, 19 and 21, and an exhaust tubulation 18. An arc generating and sustaining atmosphere, e.g., about 20 mg of mercury and argon at a pressure of 3 torr is provided within envelope 12.

Also provided within envelope 12 is an assembly 19 comprised of a plurality of tubes 20, 22, 24 and 26 each having a first end 28 and a second end 30. The tubes are coated on their interior surface with a suitable U.V. excitable phosphor.

A first arc directing means 32 is associated with first ends 28 of tubes 20, 22, 24 and 26 and comprises a first base member 34 having apertures 36 therein for receiving the first ends 28 of the tubes.

Two of the tubes, e.g., 20 and 22 have their first ends 28 provided with electrodes 38 and 40, respectively. While these electrodes may be sealed into the tube ends in a conventional manner for convenience in handling, it is not necessary that a hermetic seal be formed, and the electrodes may be mounted within the tubes in any desired manner.

A single arc director 42 is positioned on the underside of first base member 34 and covers the apertures into which the first ends 28 of tubes 24 and 26 are fitted. As shown, arc director 42 is in the form of a rectangular dish having a peripheral rim 44 about its open side. The arc director 42 is affixed to the underside by any suitable means, if it is formed separate from first base member 34, although the entire arc directing means 34 can be formed as a one piece unit.

A second arc directing means 46 is associated with the second ends 30 of tubes 20, 22, 24 and 26 and comprises a second base member 48 having apertures 50 therein for receiving the second ends 30 of the tubes.

The upper side of second base member 48, i.e., the side remote from the tubes, has two arc directors 52 and 54 positioned thereon. The arc directors 52 and 54 can be of the same construction as arc director 42. Arc director 52 encompasses the apertures receiving the second ends 30 of the tubes 20 and 24; and arc director 54 encompasses the apertures receiving the second ends 30 of the tubes 22 and 26.

A connecting rod 56 of, e.g., steel, extends between the first base member 34 and the second base member 48 and is affixed thereto, as by welding, thus securing the assembly 19 together as a unit.

The fit between the various ends of the tubes within the apertures of the base members is merely a mechanical one that is characterized as being arc tight but permeable to the arc generating and sustaining medium that is present within the hermetically sealed outer envelope 12. To aid in evacuating and to insure that the medium penetrates within the tubes, at least one of the arc directors, e.g., 54, is provided with an opening 58 therein.

Electrode 38 is mounted between supports 60 and 62 and electrode 40 mounted is between supports 64 and 66. Supports 60 and 62 are electrically connected to lead-ins 16 and 17, respectively; and supports 64 and 66 are electrically connected to lead-ins 21 and 19, respectively.

All of the supports and lead-ins are provided with a highly adherent, electrically insulating coating thereon, the coating providing an arcing potential between the lead-ins that is greater than the normal operating potential difference between them.

In a preferred embodiment the supports and lead-ins are formed from an alloy comprised of 52 wgt. percent nickel and 48 wgt. percent iron. Such an alloy is available under the name Niron from Amax Specialty Metals Corporation, Orangeburg, SC. The highly adherent coating in this preferred embodiment is provided by oxidizing the surface of the supports and lead-ins.

With the lead-ins formed from a suitable alloy having a diameter between 0.013 and 0.025 inches, an oxide coating can be provided by heating the lead-ins, and supports, to red heat (approx. 900° C.) for about 5 seconds by playing a gas-oxygen flame upon the surface of the nickel-iron alloy. This procedure forms a very adherent oxide coating on the surface. The contact resistance of the coating is about $10^4$ ohms per centimeter of length.

An alternative, and preferred method of obtaining a similar coating comprises passing an electric current through the lead-ins, in an oxidizing atmosphere; e.g., air, the intensity of the current being sufficient to heat the lead-ins to red heat.

To insure weldability of the lead-ins and supports the ends thereof can be suitably heat-sinked during the oxidizing procedures. Alternatively, the lightly oxidized ends can be swaged, the swaging lowering the surface contact resistance sufficiently to obtain good welds. If desired the welded areas, e.g., where the supports are attached to the lead-ins, could be subsequently re-oxidized.

When employed in a lamp with a normal operating potential of about 120 volts, an arcing potential of greater than 500 volts will be provided by the lead-ins described herein, thus insuring that, on starting, the desired arc path is followed and shorting between the densely packed lead-ins is avoided.

The coating is highly adherent; remains flexible; and provides no deleterious gas generation during operation.

While there have been shown and described what are at present considered to be the preferred embodiments of the invention, it will be apparent to those skilled in the art that various changes and modifications can be made herein without departing from the scope of the invention as defined by the appended claims.

We claim:

1. The method of forming an insulating oxide coating on electrical lead-ins comprising the steps of: forming a given length of said lead-ins; and heating said given length of said lead-ins to a given temperature for a given amount of time with a gas-oxygen flame, said heating being sufficient to provide said insulating oxide coating having a contact resistance of about $10^4$ ohms per centimeter of said given length of said lead-ins, said insulating oxide coating being sufficient to provide an arcing potential between said lead-ins that is greater than the normal operating potential between said lead-ins when said lead-ins are positioned in an arc sustaining atmosphere.

2. The method of claims 1 wherein said given temperature is about 900° C. and said given amount of time is about 5 seconds.

3. The method of forming an insulating oxide on an electrical lead-in which comprises the steps of: forming a given length of said electrical lead-in; and passing an electrical current through said given length of said electrical lead-in, in an oxygen atmosphere, said electrical current being sufficient to heat said electrical lead-in to red heat to provide said insulating oxide coating having a contact resistance of about $10^4$ ohms per centimeter of said given length of said lead-in.

* * * * *